United States Patent [19]

Hagemeister et al.

[11] Patent Number: 4,913,226

[45] Date of Patent: Apr. 3, 1990

[54] HEAT EXCHANGER AND ASSOCIATED METHOD

[75] Inventors: Klaus Hagemeister, Munich; Alfred Hueber, Merching, both of Fed. Rep. of Germany

[73] Assignee: MTU Motoren-und Turbinen-Union GmbH, Munich, Fed. Rep. of Germany

[21] Appl. No.: 106,113

[22] Filed: Oct. 7, 1987

[30] Foreign Application Priority Data

Oct. 20, 1986 [DE] Fed. Rep. of Germany ..... 3635549

[51] Int. Cl.[4] ..... F28D 7/06

[52] U.S. Cl. ..... 165/163; 165/176

[58] Field of Search ..... 165/163, 176, 175, 162

[56] References Cited

U.S. PATENT DOCUMENTS

| | | | |
|---|---|---|---|
| 1,139,549 | 5/1915 | Lovekin | 165/163 |
| 1,869,973 | 8/1932 | Lucke | 165/163 X |
| 1,967,961 | 7/1934 | Metten | 165/163 X |
| 2,013,309 | 9/1935 | Jackson | 165/163 X |
| 2,504,142 | 4/1950 | Mingea | 165/176 X |
| 2,920,873 | 1/1960 | Schluderberg et al. | 165/163 X |
| 3,746,083 | 7/1973 | Tiefenbacher | 165/176 X |
| 3,835,920 | 9/1974 | Mondt | 165/163 X |
| 4,786,463 | 11/1988 | Fernandez et al. | 165/163 X |

FOREIGN PATENT DOCUMENTS

| | | | |
|---|---|---|---|
| 464316 | 4/1937 | United Kingdom | 165/176 |

*Primary Examiner*—Ira S. Lazarus
*Assistant Examiner*—Peggy A. Neils
*Attorney, Agent, or Firm*—Roberts, Spiecens & Cohen

[57] ABSTRACT

A heat exchanger having an inlet duct for admission of a first fluid to be heated, an outlet duct for discharge of the first fluid after heating thereof, the ducts being arranged in substantially parallel relation, and an assembly of a plurality of heat exchanger tubes connected to the inlet and outlet ducts for receiving the first fluid from the inlet duct to convey the first fluid through the tubes for discharge into the outlet duct. The heat exchanger tubes are of U-shape each including a curved bend region in which reversal of direction of flow of the first fluid is effected. The assembly of heat exchanger tubes extends laterally of the ducts into the path of travel of a second fluid which flows around the tubes in a passage area to effect heat exchange with the first fluid in the tubes. In order to promote heat exchange in the curved bend region of the tubes, the tubes are arranged in a plurality of separate groups adjacent to one another lengthwise of the ducts and the tubes in each group converge towards one another in the curved bend regions to reduce the passage area thereat for the flow of the second fluid around the tubes.

17 Claims, 4 Drawing Sheets

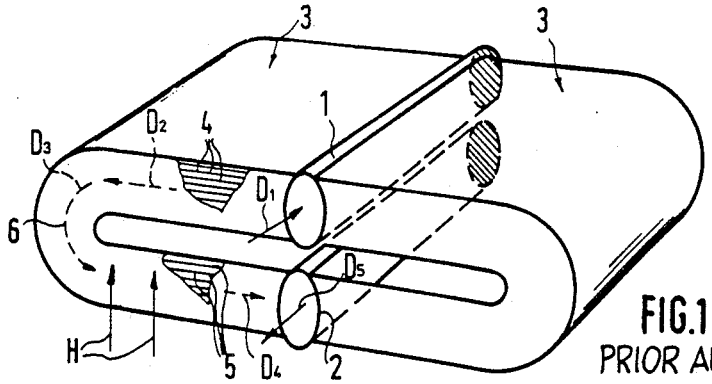
FIG.1
PRIOR ART
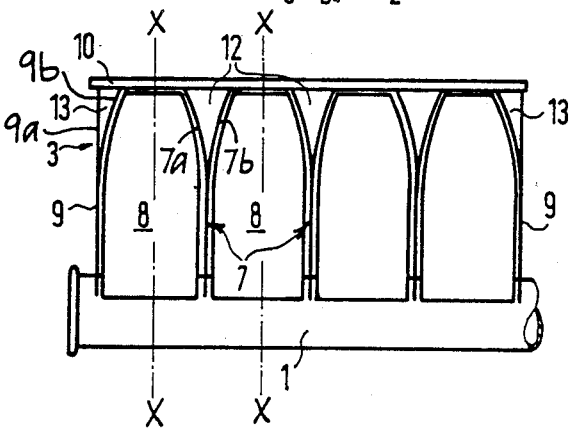
FIG. 2
FIG.2a
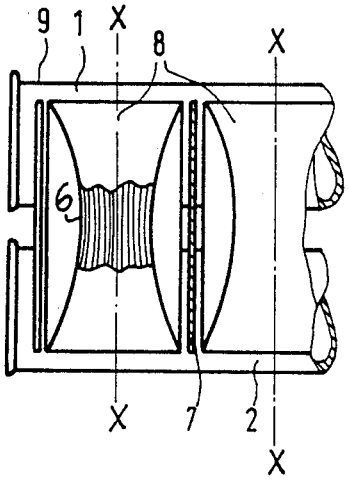
FIG. 3
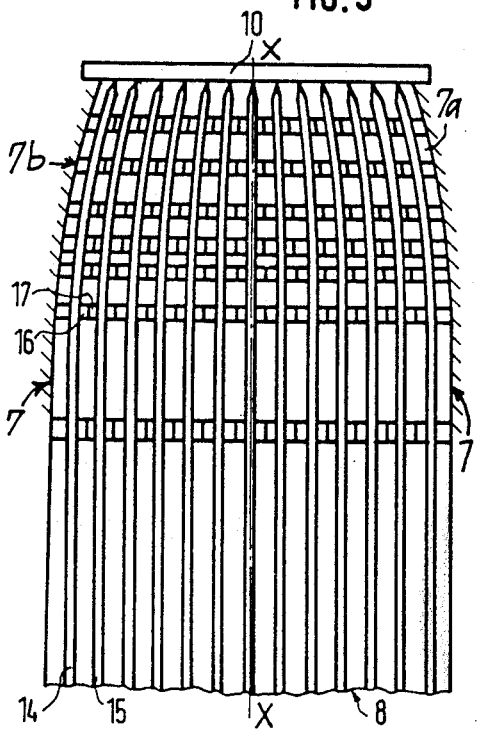

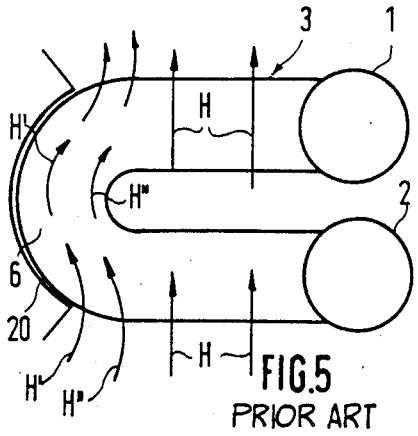
FIG.5
PRIOR ART
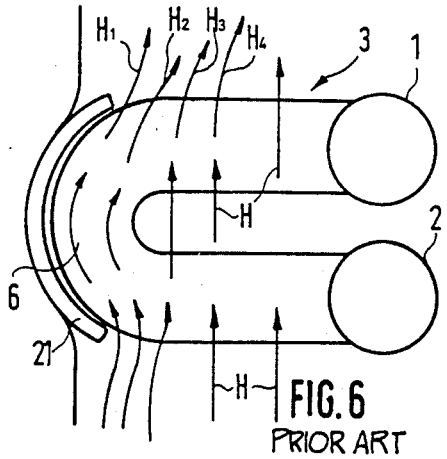
FIG.6
PRIOR ART
FIG.7
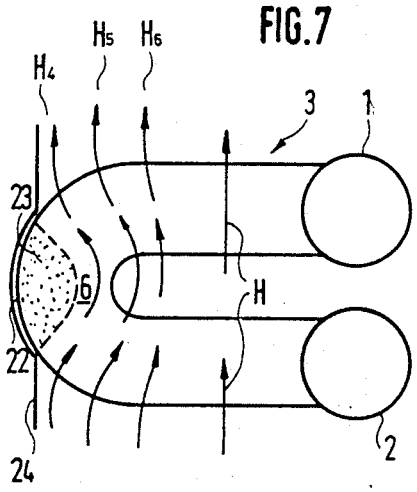
FIG.8
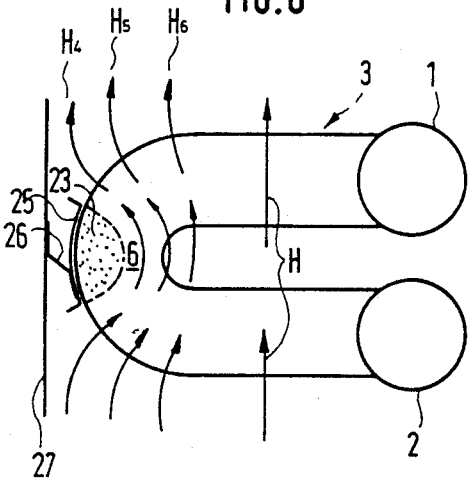
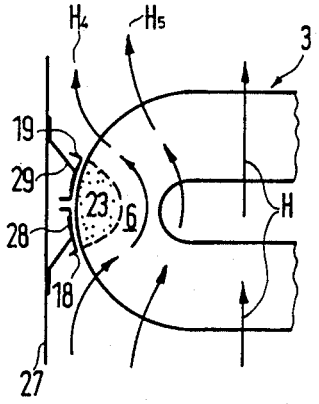
FIG.9

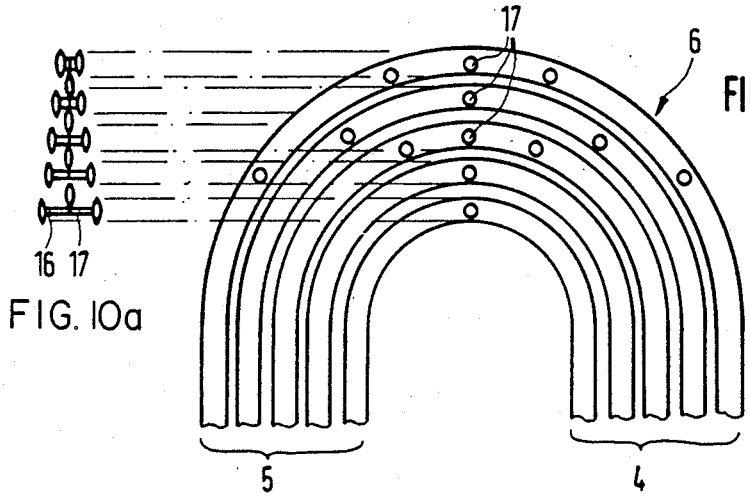
FIG. 10
FIG. 10a
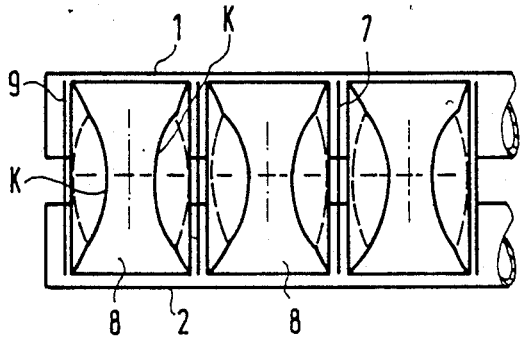
FIG. 11
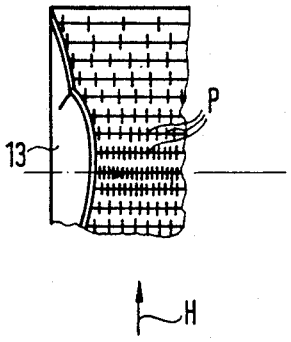
FIG. 12

HEAT EXCHANGER AND ASSOCIATED METHOD

FIELD OF THE INVENTION

The present invention relates to a heat exchanger having an inlet duct for admission of a first fluid to be heated, an outlet duct for discharge of said first fluid after heating thereof, said ducts being arranged in substantially parallel relation, and an assembly or matrix of a plurality of heat exchanger tubes connected to said inlet and outlet ducts for receiving said first fluid from the inlet duct to convey the fluid through said tubes for discharge into said outlet duct. The heat exchanger tubes are of U-shape, each including a curved bend region in which reversal of flow of said first fluid is effected, said assembly of heat exchanger tubes extending laterally of said ducts into the path of travel of a second fluid which flows in a passage area around said tubes to effect heat exchange with said first fluid in said tubes The present invention further relates to a method of improving heat exchange between the fluids in such heat exchanger.

DESCRIPTION OF PRIOR ART

A heat exchanger is known from GB-OS No. 2,130,355 in which the matrix is formed by an array of tubes in rows and columns whose ends are connected to separate feed and discharge ducts for the first fluid which is compressed air. The tubes have oval cross-sections to assure favorable guidance therearound of the second fluid, which is composed of hot gases. The tubes are easily bendable, particularly transverse to the direction of the external gas flow, so that under the action of external impact forces therefrom, the entire group of bend regions experiences elastic deflection similar to the waves of a field of wheat. Lateral bounding walls of the matrix, in combination with spacers arranged in spaced planes in the field of the tubes limit the collective deflections but cannot prevent portions of the tubes in the matrix from undergoing large deflection due to summation effects caused by play in the spacers. This is particularly the case for those parts of the bend portions which are further away from the side walls which limit the deflections, and therefore the rear parts, as seen in the direction of impact.

In this respect, considerable gaps can open up in the passage area of the matrix through which the hot gases flow whereby a bypass is produced for the hot gases so that they don't come into heat exchange interaction with the surfaces of the tubes. As a result, a considerable reduction in the efficiency of the heat exchange is obtained. Even without external impact to produce deflection, a similar effect can occur by an oscillating "waving" of the tubes if the dynamic system formed from the mass of the entire group of flexurally elastic bend portions, or even only parts thereof, and the hot gas flow which has been disturbed in the above-described manner assumes periodical alternating unstable states thereby generating aeroelastic instability.

With respect to the external flow of the hot gases around the tubes of the matrix, two regions are to be distinguished in the known heat exchanger construction in GB-OS No. 2,130,355, namely:

1. The region of the transverse flow of hot gases through the straight leg portions of the tubes of the matrix. In this region the tubes form a well-defined flow field.

2. In the region of the reverse bend portions of the tubes, the spacing and association of the tubes correspond to that of the straight leg portions but the forces acting on the tubes by the hot gases varies according to the angle of inclination of the radial vector of the tube curvature with respect to the direction of flow of the hot gases. In the region of the peak of the reverse bend, the field of the tubes of the matrix is in a position turned 90° with respect to the position of the straight legs and is traversed lengthwise thereat whereby the character of the flow surface is completely changed.

Referred to the surface unit normal to the direction of flow, the hot-gas blockage by the tubes in the plane turned 90° with respect to the regular arrangement is less, so that in the sections of the curved bend region of the tubes, representing a high proportion of the matrix traversed in this direction, there is less resistance to flow to the externally flowing hot gases as compared to the region of the straight legs of the tubes.

In addition to this, the arcuate region of the tubes is traversed by the hot gases in the same transverse direction as in the straight legs of the tubes. The linear flow paths of the transverse flow of the hot gases in the curved region therefore forms the chord of a circular arc of the corresponding tube in the curved region and is thus shorter the closer it comes to the outer edge of the curved region. Consequently, the resistance to flow of the hot gases is locally less thereat.

Since, in the basic manner of construction, both regions, i.e. the straight leg portions and the curved bend regions, represent, with respect to the outer hot gas flow, flow resistances arranged in parallel, a greater amount of hot gases tends to flow through the matrix in the curved bend region.

In the arcuate portion of the matrix in which the tubes are turned 90° relative to the direction of flow of the hot gases, there is counterflow of the two fluids in heat exchange with each other, i.e. the hot gases and the compressed air, whereby the efficiency of the heat exchange should fundamentally be better. This advantage applies only locally and to a slight extent since the arcuate region for the fluid flowing within the pipes (compressed air) represents only the intermediate section of the heat exchanger system (whose major portion is subject essentially to crossflow between the fluids).

The imbalance of the mass flow density of the hot gases caused by the different flow resistances of the two regions is therefore, as a whole, unfavorable for the effectiveness of the heat-exchange process.

SUMMARY OF THE INVENTION

An object of the invention is to provide improvements in a heat exchanger of conventional type in which the operation-produced deflections of the tubes of the matrix are limited to a tolerable amount and, in which a high degree of heat exchange is obtained in the curved bends of the tubes of the matrix.

The above and further objects are obtained according to the invention by arranging the assembly of heat exchanger tubes in the matrix in a plurality of separate groups adjacent to one another lengthwise of the inlet and outlet ducts, the tubes in each group converging toward one another in the curved bend regions thereof to reduce the passage area thereat for flow of the hot gases around the tubes.

In further accordance with the invention, the bend region of the matrix is divided into the individual groups by partition walls which constitute spacers and separate one group from the other. The partition walls serve as deflection-limiting means for the bend regions enclosed by them. Any possible summation of the play in the spacers and thus possible formation of gaps in the matrix field upon impact deflection is thus limited depending on the number of partition walls and is restricted to a tolerable amount.

For reasons of compactness of the entire heat exchanger, the partition walls should have minimum wall thickness. They are therefore themselves flexible and thus less suited by flexural rigidity to withstand the impact forces applied to the tube assembly. What has been stated above applied by analogy also to side walls, which are provided at the lateral sides of the matrix.

As a further developme-+ of the invention, these forces are not resisted by the flexural rigidity of the partition or side walls which themselves are supported on the inlet and outlet ducts but rather at the outer bend region of the matrix by provision hereat of a bounding wall which also guides external hot gas flow.

In accordance with the invention, the convergence of the curved bend regions of the groups of tubes is effected by forming the spacers as wedge-shaped elements which widen from a respective planar partition wall and form two spaced walls which follow the contour of the curved bend region. The spaced walls of the wedge-shaped spacers merge smoothly with the partition wall and gradually widen towards the outside of the curved bend region, for example, along a parabolic path. In this way, flexural rigidity of the spacer in the direction towards the boundary wall is considerably increased.

The widening of the spacer in conjunction with the convergence of the tubes in the curved bend region of the matrix produces in the curved bend region of each group, a local compacting of the tubes of the heat exchanger matrix which increases towards the plane of tangency at the tip of the curved bend region. In this way, in particular, in the outer portion of the curved bend region, the passage area for flow of the hot gases is reduced so that the resistance to flow is increased and can be adapted to that of the regions of the matrix regularly acted upon in cross flow.

As a whole, in this way also the nature of the hot gas flow on the arcuate region can be influenced as follows. With regard to the above-described compacting of the tubes of the matrix in the outer portion of the curved bend region which have a short chord length with respect to the transverse direction of flow of the hot gases, a reorientation of the flow takes place thereat into the regions of the arcuate field located radially inward. This relatively weak hot gas flow around the core of the compacted tubes makes it possible to considerably reduce the extent of an external bounding or guide wall and to make the discharge of the hot gases from the matrix uniform.

The compacting of the tubes in the arcuate region can also have effect in the direction of the arcuate chord with different intensity, for example, in that the greatest degree of compacting is obtained on the vector of the arc radius lying perpendicular to the main direction of flow while it is less intense in front of and behind same, in order to advantageously influence the hot gas flow. The wall bounding the converging region of a group can then be concave over its height and convex in the direction of its length.

In further accordance with the invention, the outer bounding wall can extend along the edge of the bend region of the matrix in facing relation with the bends of the tubes. The bounding wall can be divided in the longitudinal direction so that the part of the wall directly facing the flowing hot gases can expand independently of the relatively colder part away from the flow.

The bounding wall can be combined with the wedge-shaped spacers to resist the reaction forces. The bounding wall can be supported by a supporting structure surrounding the heat exchanger, for example, the housing so that the forces resisted by the bounding wall and the spacers can be transmitted to the supporting structure.

In order to maintain the spacing of the tubes in the bend regions corresponding to the degree of the local compaction density, lateral projections can be provided on the tubes. The height of the projections depends on the desired local density of the tubes in the field.

The projections can be formed by welding or soldering small metal plates on the tubes or by built-up welding or spraying of additional material onto the tubes.

BRIEF DESCRIPTION OF THE FIGURES OF THE DRAWING

FIG. 1 is a diagrammatic perspective view, partly broken away, of a eat exchanger according to the prior art.

FIG. 2 is a plan view diagrammatically illustrating a heat exchanger according to the invention in which groups of heat exchanger tubes in a single row are shown extending laterally from ducts for flow of compressed air.

FIG. 2*a* is a front elevational view of a portion of the heat exchanger in FIG. 2 in which two groups of heat exchanger tubes are visible.

FIG. 3 is a top plan view of one group of the heat exchanger tubes in FIG. 2 in greater detail.

FIG. 5 is a side elevational view of the heat exchanger of FIG. 1 of the left section of the tube matrix showing the conventional flow path of the hot gases.

FIG. 6 is a view similar to FIG. 5 with a modified bounding wall at the outer bend region of the matrix.

FIG. 7 is a view similar to FIG. 5 showing the flow path of the hot gases according to one embodiment of a bounding wall in the heat exchanger of the invention.

FIG. 8 is similar to FIG. 7 showing another embodiment of a bounding wall in the heat exchanger of the invention.

FIG. 9 is similar to FIG. 8 showing another embodiment of a bounding wall in the heat exchanger of the invention.

FIG. 10 is a side view of a vertically arranged bend region of the tube matrix of the invention.

FIG. 10*a* is an end view of the tube matrix of FIG. 10 showing the increasing constriction of the passage area of the hot gases which takes place from the tubes at the inner side of the bend region to the outer side of the bend region.

FIG. 11 is a diagrammatic illustration of a front elevational view of a portion of the heat exchanger according to the invention without the bounding wall and housing.

FIG. 12 illustrates a detail of a portion of one group of heat exchanger tubes in FIG. 11 showing the local construction of the tubes and the reduction of the passage area for the hot gases around the tubes.

DETAILED DESCRIPTION OF PREFERRED EMBODIMENTS

Figure 4:
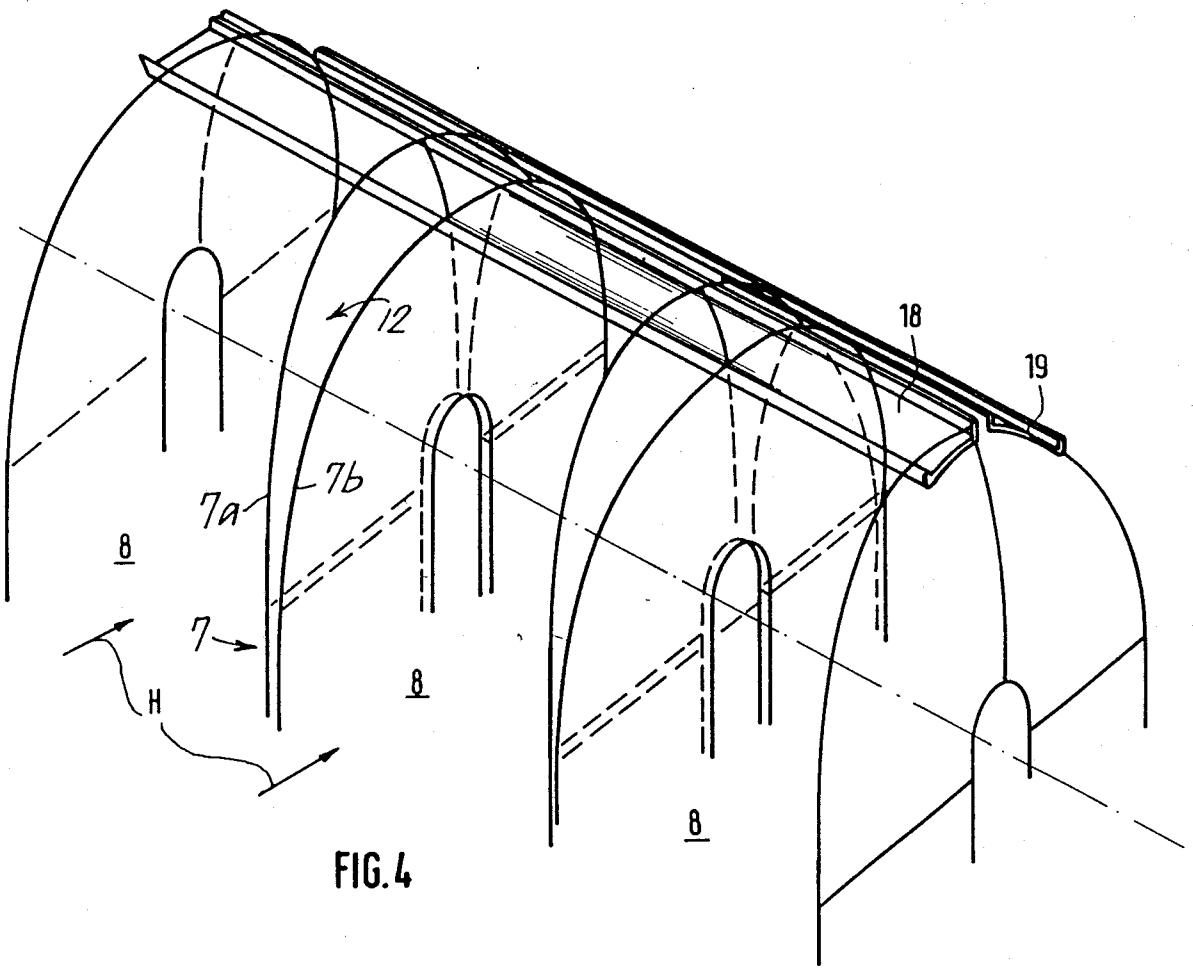
FIG. 4 is a diagrammatic perspective view of adjoining groups of heat exchanger tubes associated with a bounding wall divided longitudinally facing the outer bend region of the tubes of the matrix.

Referring to FIG. 1, therein is seen a conventional heat exchanger which comprises an assembly or matrix 3 of heat exchanger tubes of U-shape which are positioned within a housing or casing (not shown) such that heated gases H can flow over the tube matrix 3 in the direction of the arrows.

The U-shaped tubes of the matrix 3 have straight legs 4 connected to an inlet duct 1 and straight legs 5 connected to an outlet duct 2. The ducts 1 and 2 extend substantially parallel to one another in a direction perpendicular to the flow of hot gases H. The tubes of the matrix extend in equally spaced parallel relation in the matrix along the length of ducts 1 and 2 and the tubes project transversely of the ducts into the path of flow of gases H.

A fluid, such as compressed air, is supplied to the duct 1 as shown at $D_1$ and the fluid flows from duct 1 into the straight legs 4 of the heat exchanger tubes along path $D_2$. The compressed air undergoes reversal of direction along path $D_3$ in the curved bend portion of the U-shaped tubes in an arcuate region 6 of the matrix whereafter the compressed air flows in straight legs 5 of the heat exchanger tubes along path $D_4$ into duct 2 from which the compressed air is discharged at $D_5$. The ducts 1 and 2 are closed at their rear ends as shown by the hatching thereat.

In its path of travel through the tubes of the matrix, the compressed air is heated by the gases H flowing around the exterior of the tubes so that the compressed air discharged from duct 2 is heated. The heated compressed air discharged from duct 2 can be supplied to a suitable utilization means, such as the combustion chamber of a gas turbine power plant.

The curved U-portions or bends of the heat exchanger tubes face a bounding guide wall 20 (FIG. 5) in the bend region of the tubes which influences the flow path of the hot gases H in the arcuate region of the tubes as will be explained in greater detail later.

The tubes of the matrix 3 are arranged in staggered relation in rows and columns in parallel relation and the tubes are oval in cross-section to provide streamlined flow of the hot gases H therearound.

The two ducts 1, 2 can be integrated in a common duct or manifold with a partition therein.

The invention is concerned with improving the tube assembly or matrix 3 of the prior art and contemplates arranging the matrix 3 in separate groups 8 adjacent to one another along the length of the ducts 1 and 2. Each group 8 of tubes is separated from the adjacent group by a partition 7.

As evident from FIGS. 2, 2*a* and 3, the tubes of each group 8 converge in the curved bend region to reduce the passage area thereat for flow of hot gases H around the tubes. As shown, the tubes converge uniformly and symmetrically towards a center plane denoted by X—X which extends transversely of the ducts 1 and 2 and longitudinally at the center of each separate group 8 of the tube matrix. In order to achieve the constricted flow passage area in the region of the curved bend portion of each group 8, the endmost tubes of group 8 converge maximally towards the center plane X—X and the magnitude of the convergence diminishes towards the center of the group whereat the tubes are disposed substantially in the center plane X—X. The curvature of the tubes of each group 8 of the matrix is such that the group has an outer contour which has a taper of wedge shape which can be parabolic towards the outer bend region of the matrix.

At the lateral sides of the matrix 3, the heat exchanger has side walls 9 as shown in FIGS. 2 and 2*a*.

Facing the arcuate region 6 of the matrix is an end wall 10 which serves as a boundary for flow of hot gases H in the curved bend region of the matrix as will be explained later.

The partitions 7 and the side walls 9 are secured to the end wall 10 which extends along the entire length of the matrix 3. The partitions and the guide walls can be made relatively flexible.

As furthermore noted from FIG. 2, as a result of the convergence of the tubes in adjacent groups 8, wedge-shaped intermediate spaces are formed between adjacent groups and between the endmost groups 8 and the side walls 9. These wedge-shaped spaces are filled with respective filling elements 12, 13 to block flow of hot gases H therethrough. The filling of the wedge-shaped spaces is achieved by forming partition 7 and side walls 9 as double wall elements. Namely, partition 7 is formed by partition walls 7*a*, 7*b* and side walls 9 are formed by wall elements 9*a*, 9*b*. The partition walls 7*a*, 7*b* follow the curvature of the adjoining curved tubes of the adjacent groups. The partition walls 7*a*, 7*b* are formed with a covering so that the wedge-shaped filling element formed thereby is closed and prevents flow through the wedge-shaped space that it fills. Similarly, the wall elements 9*a*, 9*b* are formed with a covering so that the filling element formed thereby is closed and blocks flow through the wedge-shaped space that it fills.

FIG. 3 shows how the tubes of a group 8 are made to converge in their curved bend region between partition walls 7*a*, 7*b* of the partitions between adjacent groups. Referring to the outermost tubes 14, 15 of the group 8 in FIG. 3, the partition walls bear against adjacent tubes via lateral projections 16 on the tubes which maintain a spacing therebetween, and the adjacent tubes bear against one another by lateral projections 16 of one tube against lateral projections 17 of the other tube to maintain the spacing therebetween. The spacing between the tubes of the entire group 8 is maintained by engagement of the lateral projections 16, 17 thereon. The lateral projections 16, 17 also contribute to a reduction in the flow passage of the hot gases H between the tubes.

The projections 16, 17 can be produced by welding or soldering of small metal plates on the tubes or by build-up of weld material or sprayed material on the corresponding profiled tubes.

FIG. 4 diagrammatically shows in perspective the contour of the individual convergent groups 8 of the heat exchanger in association with an end wall facing the peak of the bend region 6 of the tube matrix and formed by two longitudinal shell elements 18, 19 spaced from one another. In this way, the shell element 18 which the hot gases H first contact can expand independently of the relatively colder shell element 19 on the side away from the direction of flow.

FIGS. 1, 5 and 6 show the disadvantages in the known construction of the heat exchanger as briefly summarized as follows.

Regular optimal flow conditions of the hot gases H only prevail in the straight legs 4, 5 of the tube matrix 3 in which the straight legs extend linearly transversely of the hot gas flow H (FIG. 1). In these local regions of the matrix, the individual tubes are arranged uniformly and are staggered to internest with one another to assume a predetermined uniform flow of hot-gases. The hot gases H can flow around the profiled tubes and provide effective heat exchange in a cross/counterflow heat-exchange process between the hot gases flowing around the tubes and the compressed air flowing within the tubes.

Due to the curved bend region in which flow reversal takes place, blockage of the hot gases is relatively slight thereat and an imbalance is produced between the mass flow density of the hot gases in the arcuate region 6 and the rows of straight legs 4, 5. The heat exchange process between the hot gases and the compressed air is relatively unfavorable in the arcuate region 6. In an attempt to constrain the hot gas stream to flow along the tubes in the arcuate bend region, relatively long curved end walls 20, 21 are provided.

The portions of the hot gas flowing in the arcuate region 6 of the matrix 3 (FIG. 6) at relatively high velocity (arrows $H_1$, $H_2$) can impair the flow of the hot gases in the remainder of the matrix (arrows $H_3$, $H_4$).

Within the scope of the invention as described with reference to FIGS. 2 to 4, it is possible by the local convergence of the bend portions of the tubes and the formation of filled wedge-shaped spaces and also by the provision of the projections 16, 17 serving as spacers, for the tubes to form a reduced passage area 23 for flow of hot gases (shown in dotted outline), which extends from the outermost peripheral contour 22 along a curved outline extending to substantially the center of the curved bend region 6 along a path curved in the opposite direction of contour 22. In contradistinction to FIGS. 5 and 6, therefore, as shown in FIGS. 7 and 8, the essential part of the curved region 6 of the matrix can also be traversed by the hot gases as shown by arrows $H_4$, $H_5$ such that an effective crossflow/counterflow heat-exchange process can take place. At the same time, the imbalance of the mass flow density in the curved bend region 6 of the matrix 3 and the straight leg portion 4, 5 (FIG. 1) can be substantially eliminated and an undisturbed homogeneous flow be obtained through the entire matrix 3. Moreover, this is obtained with substantially equal velocities of flow of all portions of the hot gases through the matrix 3, i.e. H, $H_4$, $H_5$, $H_6$.

In accordance with FIG. 7, the end wall 22 along the outer bends of the tubes of the matrix 3 is formed, for example, as a part of the housing 24 which guides the flow of hot gases, and wall 22 can be made relatively short, i.e. it can extend a small distance in the arcuate direction, while the housing 24 can extend parallel to the main direction of flow H of the hot gases.

FIG. 8 shows another embodiment which achieves the same advantageous manner of operation as in FIG. 7. FIG. 8 differs from FIG. 7 essentially in that, the end wall 25 which is made relatively small in the arcuate direction, is resiliently mounted on the adjacent heat exchanger housing 27 by a structural mounting 26. Seals (not shown) for blocking flow of hot-gases are provided between end wall 25 and housing 27 for cooperating indirectly or directly with the mounting 26 so as to compensate for relative movement between wall 25 and housing 27.

FIG. 9 differs from FIG. 8 by the use of longitudinally divided shell elements 18, 19, previously described with reference to FIG. 4. The shell elements 18, 19 are resiliently supported on housing 27 by mountings 28, 29 which can accomodate relative displacement of the shell elements with respect to the housing.

FIGS. 10 and **10*a* diagrammatically illustrate the constriction of the flow passage for the hot-gases due to the local convergence of the curved ends of the tubes in each block. In this respect, FIG. 10 shows a row of U-shaped tubes of the matrix disposed in a common plane. In combination with the projections 17 on one side surface of the tubes within the arcuate region 6, the compaction of the tubes increases from the inner to the outer arcuate region between two adjacent rows of tubes which contact one another by respective projections 16, 17 as shown in FIG. 10*a*. In FIG. 10*a*** the corresponding spacing between the tubes has been shown relatively large for the sake of clarity.

Also evident in FIG. **10*a*** is the three-dimensional internested engagement of the profiled tubes as well as their formation as hollow members of oval cross section.

The intensity of the weak flow zone 23 of the hot gases mentioned previously in FIGS. 7, 8 and 9 can be further promoted in accordance with FIGS. 11 and 12 in that, in addition to the convergence of the tubes, for instance in accordance with FIG. 2, the groups of tubes 8 which extend transversely from the corresponding ducts 1, 2 are pushed further together, at curvature sections K which are uniformly concave on both sides, in the direction towards the center plane of the group such that in the center of the outer region of the curved part of the matrix there is developed between adjacent profiled tubes P and associated spacers, a weak-flow zone for hot gases which first of all continuously narrows in the direction of the hot gas flow H (FIG. 12) and then widens again continuously.

From FIG. 12 it can furthermore be noted that by filling the wedge spaces with double wall inserts, i.e. insert 13 (see also FIG. 2), the curved walls can follow the concave sections K and form bounding walls for the flow passage. This applies, of course, also to the double-wall inserts 12 corresponding to the partition walls 7 (FIG. 2).

Although the invention has been described above in relation to specific embodiments thereof, it will become apparent to those skilled in the art that numerous modifications and variations can be made within the scope and spirit of the invention as defined in the attached claims WHAT IS CLAIMED IS.

What is claimed is:

1. A heat exchanger comprising an inlet duct for admission of a first fluid to be heated, an outlet duct for discharge of said first fluid after heating thereof, said ducts being arranged in substantially parallel relation, a matrix assembly of a plurality of U-shaped heat exchanger tubes connected to said inlet and outlet ducts for receiving said first fluid from said inlet duct to convey said first fluid through said tubes for discharge into said outlet duct, said heat exchanger tubes extending transversely from said inlet and said outlet duct into the path of flow of a second fluid, said tubes of the matrix assembly forming first and second straight line matrix sections extending into a common curved bend matrix section in which reversal of flow of said first fluid is effected, said tubes of said first and second matrix sections each providing flow fields and respective through flow areas for said second fluid differing from the flow field and respective through flow areas of said tubes in said curved bend matrix section, said matrix assembly being divided into a plurality of separate groups adjacent to one another lengthwise of said ducts, each group of tubes having a central longitudinal plane extending perpendicularly to said ducts, said curved bend sections of said tubes in each group converging uniformly towards said central longitudinal plane, to locally reduce the flow areas between said tubes in said curved bend matrix section the curved bend sections of the tubes in each group on opposite sides of said central longitudinal plane being of opposite curvature.

2. A heat exchanger as claimed in claim 1 comprising partition means between adjacent groups of tubes.

3. A heat exchanger as claimed in claim 1 wherein said assembly has opposite lateral sides and said heat exchanger further comprising guide walls at said lateral sides of the assembly.

4. A heat exchanger as claimed in claim 3 wherein adjacent groups of tubes define wedge-shaped intermediate spaces therebetween, said guide walls at the lateral sides of the assembly forming further wedge-shaped spaces between said guide walls and the groups of tubes adjacent thereto, said heat exchanger further comprising means filling said wedge-shaped intermediate spaces and said further wedge-shaped spaces to block flow of said second fluid in said spaces.

5. A heat exchanger as claimed in claim 4 wherein said means which fills the intermediate spaces comprises a body conforming to the wedge-shape of each said intermediate space connected to a respective partition means.

6. A heat exchanger as claimed in claim 5 wherein each body includes bounding walls facing the adjacent groups of tubes.

7. A heat exchanger as claimed in claim 4 wherein said means which fills the further wedge-shaped spaces comprises a body conforming to the wedge shape of each said further space connected to a respective guide wall.

8. A heat exchanger as claimed in claim 7 wherein each body includes a bounding wall facing the adjacent group of tubes.

9. A heat exchanger as claimed in claim 4 further comprising an end wall extending adjacent to said assembly of tubes lengthwise thereof opposite said curved bend regions, said means filling said wedge-shaped intermediate spaces and said further wedge-shaped spaces being connected to said end wall.

10. A heat exchanger as claimed in claim 1 wherein said heat-exchange tubes in said assembly are spaced apart and in said curved bend regions in which the tubes converge towards one another said tubes transversely approach one another to reduce the transverse spacing therebetween and thereby reduce said passage area for flow of said second fluid.

11. A heat exchanger as claimed in claim 10 wherein the convergence of said tubes in said curved bend regions defines a zone of reduced flow serving as a means for diverting flow of said second fluid through said curved bend region to promote heat exchange with the first fluid flowing in said tubes and provide substantially uniform mass density of flow of said second fluid through the tubes of the matrix assembly.

12. A heat exchanger as claimed in claim 11 further comprising a housing receiving said assembly of heat exchanger tubes, and an end wall on said housing extending adjacent to said assembly of tubes lengthwise thereof opposite said curved bend regions.

13. A heat exchanger as claimed in claim 12 comprising means resiliently supporting said end wall on said housing.

14. A heat exchanger as claimed in claim 12 wherein said end wall comprises two adjacent shell elements extending lengthwise of the assembly of tubes.

15. A heat exchanger as claimed in claim 10 comprising lateral projections on said tubes engaging one another to space the tubes apart.

16. A heat exchanger as claimed in claim 15 wherein said lateral projections comprise built-up material formed by welding or spraying.

17. A heat exchanger as claimed in claim 1 wherein said tubes to define a guide zone for said second fluid which first continuously narrows in the direction of flow of the second fluid and then continuously widens.

* * * * *